US005408256A

United States Patent [19]

Keen et al.

[11] Patent Number: 5,408,256

[45] Date of Patent: Apr. 18, 1995

[54] REFILLABLE COLOR INK JET CARTRIDGE AND METHOD FOR MAKING SAID CARTRIDGE

[75] Inventors: Robert Keen, Teaneck; Fred Keen, Tenafly; Donald R. Beck, Pompton Plains, all of N.J.

[73] Assignee: Repeat-O-Type Manufacturing Company, Inc., Wayne, N.J.

[21] Appl. No.: 919,970

[22] Filed: Jul. 27, 1992

[51] Int. Cl.[6] ..... B41J 2/175

[52] U.S. Cl. ..... 347/87

[58] Field of Search ..... 346/140 R, 1.1; 400/126; 347/85, 86, 87

[56] References Cited

U.S. PATENT DOCUMENTS

| | | | |
|---|---|---|---|
| 4,500,895 | 2/1985 | Buck et al. | 346/140 R |
| 4,771,295 | 9/1988 | Baher et al. | 346/1.1 |
| 5,182,581 | 1/1993 | Kashimura et al. | 346/140 R |
| 5,199,470 | 4/1993 | Goldman | 141/1 |

*Primary Examiner*—Benjamin R. Fuller
*Assistant Examiner*—N. Le
*Attorney, Agent, or Firm*—W. Patrick Quast

[57] ABSTRACT

A refillable color ink jet cartridge and method for making same is described. The protective cap on the non-refillable Hewlett-Packard cartridge #51625A (used in printing devices such as the Hewlett-Packard Desk Writer C) and similar cartridges is removed to access the color ink reservoirs to extend the service life of the cartridge. Once pried loose or otherwise removed, the protective cap is modified for convenient reconnection to the cartridge.

11 Claims, 5 Drawing Sheets

REFILLABLE COLOR INK JET CARTRIDGE AND METHOD FOR MAKING SAID CARTRIDGE

BACKGROUND OF THE INVENTION

This invention relates to color ink jet cartridges, and in particular to user refillable color ink jet cartridges.

The ink jet printing process is now used for full color printing of computer generated documents. For example, Hewlett-Packard Company (3000 Hanover, P.O. Box #10301, Palo Alto, Calif. 94303-0890, USA) has developed full color printers such as their Hewlett-Packard Desk Writer C, in which the ink jet printhead and the three primary colored inks are all contained in a single, disposable cartridge. This cartridge is Hewlett-Packard #51625A, which has an upper portion with three chambers, said chambers containing cyan, magenta, and yellow inks respectively, and a lower portion with fine orifices controlled by printed circuits to dispense the ink under computer control. Said upper portion of this cartridge contains three air vent/ink refill holes which are protected by a cap.

The advantage of the above described color ink jet dispensing system is that the cost of the system is reduced since the consumable parts are not in the equipment itself, but rather in the disposable print cartridge, thereby reducing maintenance costs. However, the cost of each copy is increased due to the fact that the entire cartridge (including the printhead) must be discarded even if only one color is depleted, with the other two ink colors still in good condition.

The instant invention addresses the above mentioned disadvantage by disclosing a method for converting a non-refillable color ink jet cartridge into a user refillable cartridge, thereby providing an economical refillable color ink jet cartridge for continued and future use.

SUMMARY OF THE INVENTION

Accordingly, it is a primary object of the invention to provide a refillable color ink jet dispensing system.

Another object is to provide an economical color ink jet dispensing system.

Still another object is to provide a color ink jet dispensing system that is less of an environmental contaminent.

A further object of the invention is to permit extended use of a printhead in a color ink jet dispensing system.

Another object of the invention is to permit printing a maximum number of copies with a single color ink jet dispensing system.

Still another object of the invention is to allow user refilling of depleted colors in a color ink jet dispensing system.

These and other objects are obtained by the instant invention. A non-refillable color ink jet cartridge such as the Hewlett-Packard #51625A can be converted into a refillable cartridge. The upper portion of this cartridge contains the three air vent/ink refill holes, and this upper portion has a plastic cap capable of being removed. After placing the body of the plastic cartridge on a suitable support such as, for example, the edge of a table, the protective plastic cap covering the upper portion of the cartridge can be removed by prying it off of a cartridge with a sharp instrument such as a knife. This upper protective cap can be removed by other suitable means, of course, including dissolving the adhesive bond away that holds the cap to the body of the cartridge, using a solvent that will not harm the cartridge itself.

With this upper protective cap off the three air vent/ink fill holes in the top exposed surface of the upper portion of the cartridge can now be accessed. Commercially available refill ink bottles, with one bottle containing cyan ink, the second magenta ink, and the third bottle containing yellow ink, together with their commercially available filler tubes are now used to fill one or more of the air vent/ink fill holes in need of replenishment.

The upper protective cap can now be modified so that it can be placed snugly back onto the main cartridge body as often as is necessary to replenish depleted ink supplies. A variety of methods can be employed to do this, including placing two adhesive backed pads at both sides of the longitudinal length of the upper protective cap. In this manner a snug friction fit is obtained against the outer surfaces of the four posts which extend above the top, exposed surface of the upper portion of the cartidge when the upper protective cap is removed.

By making the upper protective cap removable the cartridge ink supply can now be replenished up to 10 times before the printhead wears out. This permits up to 2,500 color copies now being made with a single cartridge, as compared to up to 250 copies with the non-refillable cartridge.

DETAILED DESCRIPTION OF THE PREFERRED EMBODIMENTS

Figure 1:
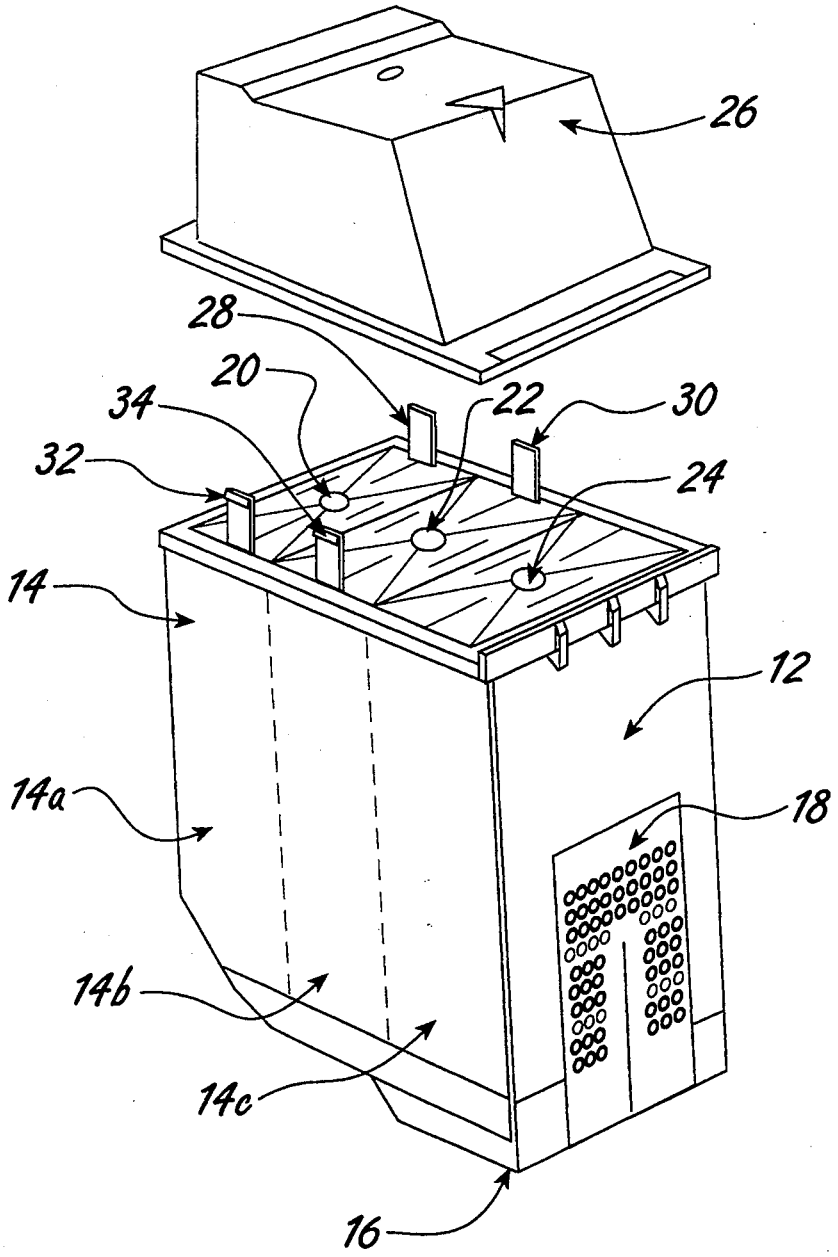
FIG. 1 is a perspective view of the refillable color ink jet cartridge of the invention, showing the upper protective cap separated from the main body of the cartridge.
Figure 2:
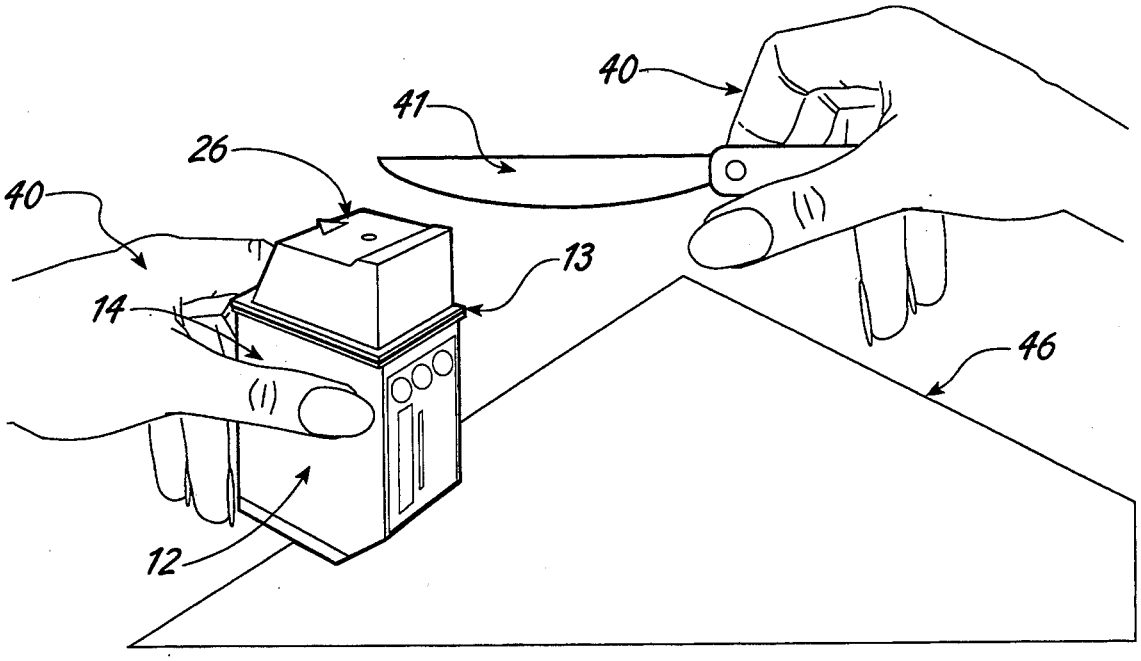
FIG. 2 illustrates the color ink jet cartridge of the invention secured to a table top in preparation for removal of the upper protective cap with a knife.

Referring now to FIG. 1 the color ink jet cartridge 10 of the invention is shown. Upper protective cap 26 is shown already detached from the main cartridge body 12. Cartridge 10 is Hewlett-Packard color ink jet cartridge #51625A used for color copy reproduction devices such as the Hewlett-Packard Desk Writer C and similar printing systems. Relevant details of a main cartridge body similar to the cartridge body employed in Hewlett-Packard's #51625A cartridge, is depicted in U.S. Pat. No. 4,771,295, issued Sep. 13, 1988. This patent actually depicts Hewlett-Packard's #51606C cartridge used in their paint jet systems. The actual #51606C cartridge as furnished by the manufacturer does not include a protective cap such as 26 in the instant application. The #51625A cartridge does come from the manufacturer with the cap 26 and with the posts 28, 30, 32 and 34. Further, the ink delivery system of the #51625A cartridge is somewhat different from the #51606C system, but this is of no relevance to the invention described hereinafter. The ink containing chambers and access holes thereto as described in the '295 patent are generally identical to those employed in the #51625A model. Cartridge 10 is supplied from the manufacturer with cap 26 and body 12 cemented together. Cartridge 10 is now mounted at the edge of a table 46 (FIG. 2), and a knife 41 (FIG. 2) or similar sharp object is employed to pry off cap 26 from the main cartridge body 12 at the point of attachment 13 (FIG. 2) where cap 26 is cemented to the upper portion 14 of body 12. A variety of other methods can be used to dislodge protective cap 26, including using a suitable solvent to dissolve this cement junction between cap 26 and cartridge body 12.

The upper portion 14 of body 12 contains three separate ink chambers 14A, 14B, and 14C. Cartridge body 12 also has a lower portion 16 with ink dispensing orifices/printer circuit board 18. The top surface of upper portion 14, accessed when protective cap 26 is removed, contains air vent/ink refill holes 20 (opening to ink area 14A), 22 (opening to ink area 14B), and 24 (opening to ink area 14C), and also posts 32, 34, 28, and 30. There are two posts positioned along the longitudinal length of each side of the top surface of upper portion 14, and they extend upwardly from this surface.

Figure 3:
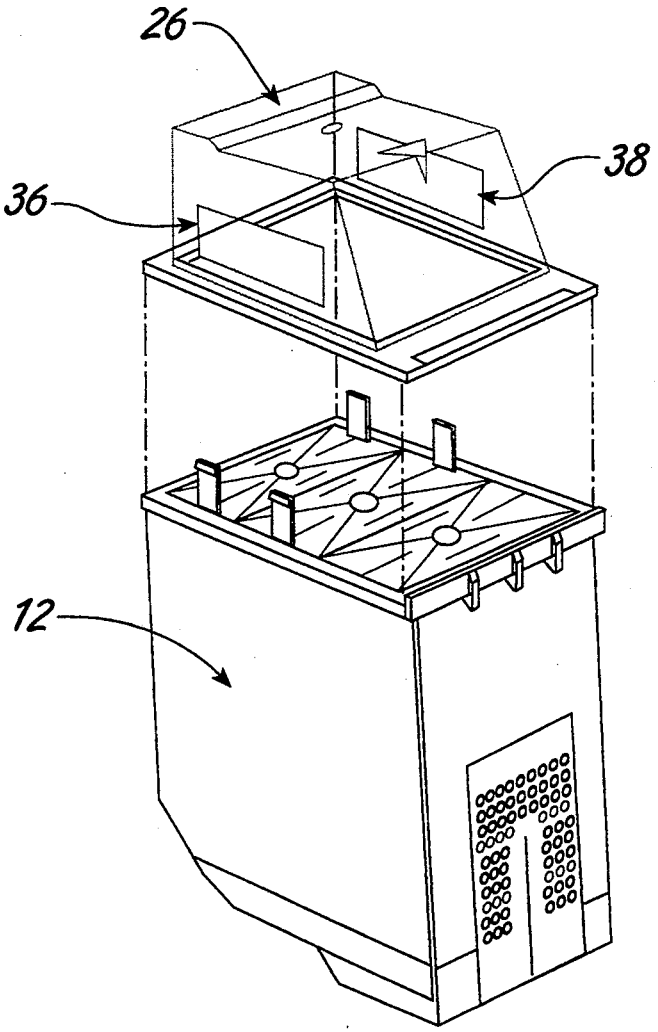
FIG. 3 is a perspective view of the upper protective cap of the cartridge illustrating in phantom the two adhesive backed friction pads in place.

In order to conveniently replenish and thereby use cartridge 10 over and over it is desirable to be able to snugly reconnect cap 26 to body 12. FIG. 3 illustrates a preferred method for providing this snug fit. Adhesive backed friction pads 36 and 38 are connected opposite each other on the facing inside longitudinal walls of cap 26. In this manner pads 36 and 38 provide a friction fit between the longitudinal walls of cap 26 and posts 28, 30, and 32, 34 (FIG. 1) on cartridge main body 12. Other methods that can be employed include replacing pads 36 and 38 with rivet or screw heads properly located on the cap 26 to engage with the posts 20, 30, 32, and 34. Or the protective cap 26 can be replaced with a custom molded replacement head, or the cap can be left off after refilling or the like.

Once cartridge 10 has been modified for ink refilling as described above, the following procedure can be employed whenever ink replenishing is required:

(A) Remove cartridge 10 from the printer (not shown).

Figure 4:
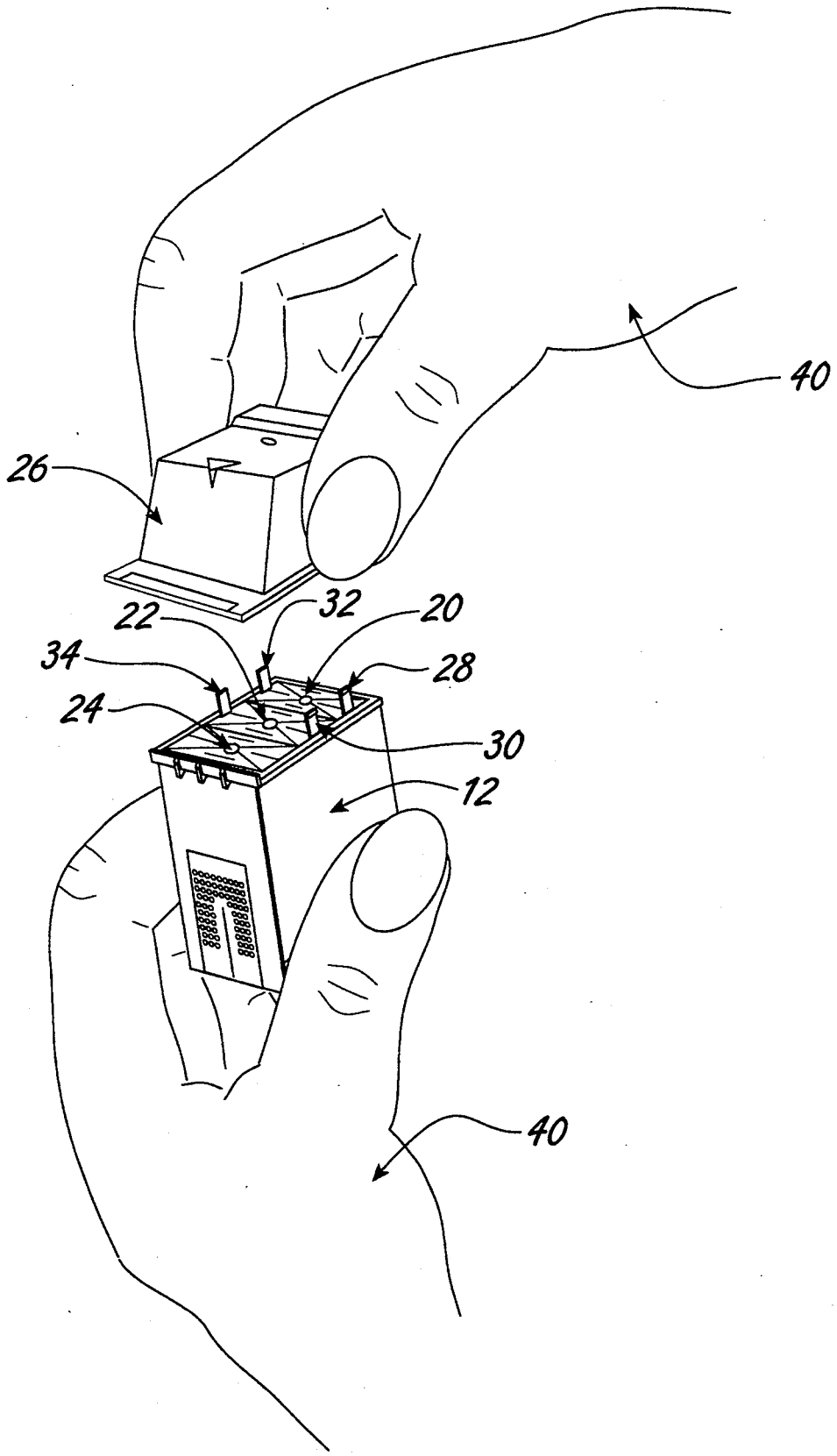
FIG. 4 illustrates a typical procedure for preparing the color ink jet cartridge for ink replenishing.

(B) Using your hands 40 (FIG. 4), hold the cartridge body 12, remove protective cap 26. This exposes the air vent/ink refill holes 20, 22, and 24.

(C) The color of refill ink corresponding to the color of ink that has been depleted from the cartridge 10 is obtained in a bottle (preferably a plastic squeeze bottle), which bottle comes supplied with a hypodermic type filler tube of small enough gauge to insert into air vent/ink refill holes 20, 22, and 24. Suitable bottles supplied with hypodermic type filler tubes, together with suitable colored inks are commercially available, and well known to the art.

Figure 5:
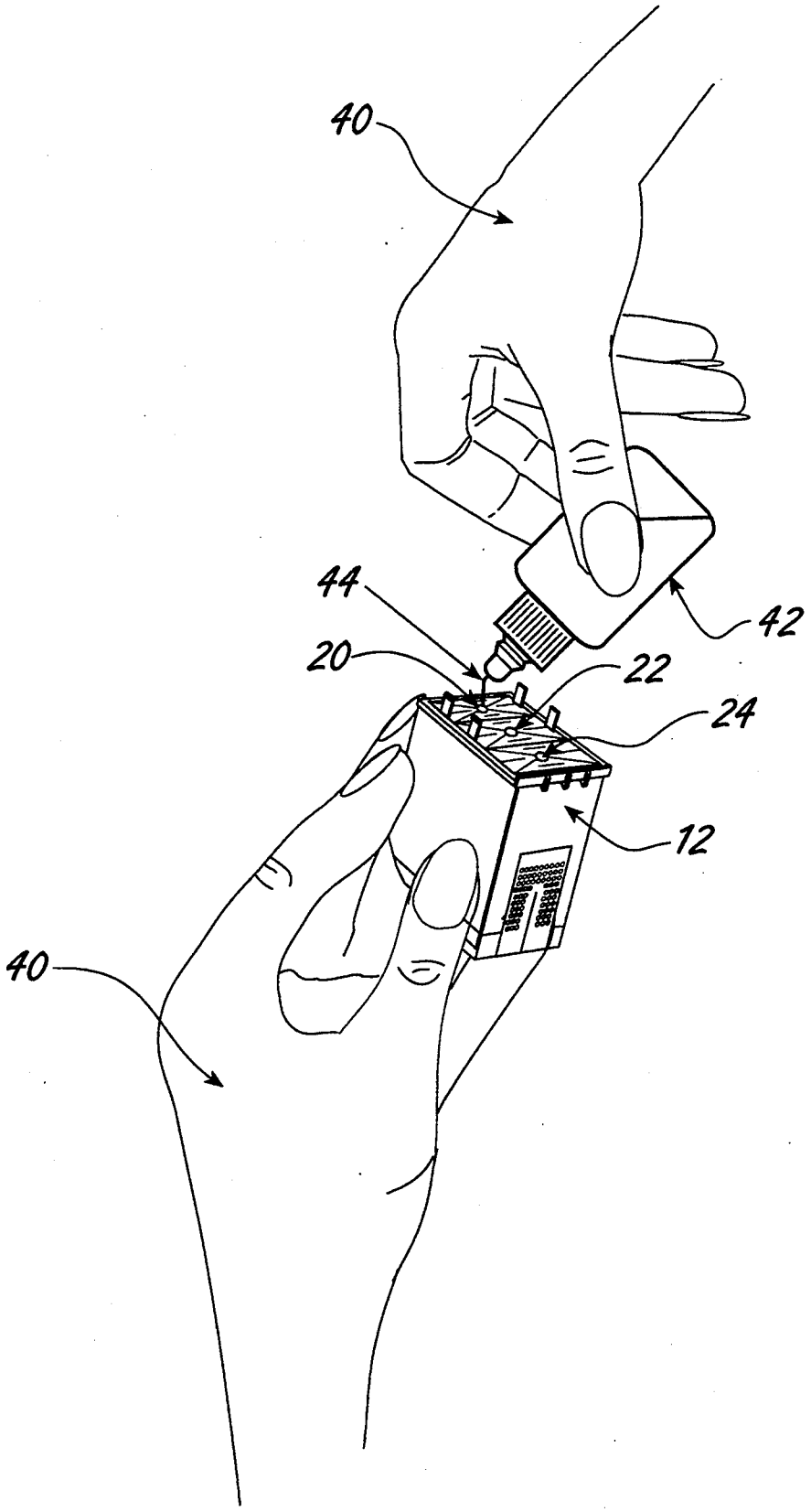
FIG. 5 illustrates a typical procedure for replenishing ink in one of the three ink compartments within the color ink jet cartridge.

(D) Using your hands 40 (FIG. 5) to hold cartridge 10, filler tube 44 is connected to the appropriate air vent/ink refill hole (e.g. 20-FIG. 5). Ink containing bottle 42 is then squeezed to fill an ink fill area (e.g. 14A-FIG. 1) to a suitable level.

(E) Cap 26 is then replaced on cartridge 10 main body 12, and the cartridge is put back into the printing device.

The above procedure for converting the Hewlett-Packard color ink jet cartridge #51625A can also be employed for similar non-refillable color ink jet cartridges wherein the ink reservoirs can be accessed.

Since many changes could be made in the above constructions and many apparently widely different embodiments of this invention could be made without departing from the scope thereof, it is intended that all matter contained in the above description or shown in the accompanying drawings shall be interpreted as illustrative, and is to be limited only by the following claims.

What is claimed is:

1. A method for making a user refillable ink jet cartridge, said cartridge having an upper portion and a lower portion and protective cap, said upper portion having at least one chamber for containing ink, said upper portion containing holes providing access to each of said at least one chamber, said cap being affixed to said upper portion such that said holes are covered by said protective cap, said method comprising the steps of:

removing said protective cap from said upper portion of said cartridge;

modifying said protective cap so that said cap can be reconnected to said cartridge after said cap has been removed from said upper portion of said cartridge; and, reconnecting said protective cap to said upper portion, whereby the user can replenish the ink by removing said modified protective cap and injecting the ink through a respective one of said holes into a particular one of said at least one chamber wherefrom said ink has been consumed.

2. The method according to claim 1 wherein said step of removing said protective cap comprises the step of prying off said protective cap from said upper portion of said cartridge utilizing a sharp utensil.

3. The method according to claim 1 wherein said protective cap and said upper portion of said cartridge are adhesively bonded together, said step of removing said protective cap from said upper portion of said cartridge comprises the step of dissolving said adhesive bond between said protective cap and said upper portion of said cartridge.

4. A method for making a user refillable ink jet cartridge, said cartridge having an upper portion and a lower portion and a protective cap, said upper portion having at least one chamber for containing ink, said upper portion containing holes providing access to each of said at least one chamber, said cap being affixed to said upper portion such that said holes are covered up by said protective cap, said method comprising the steps of:

removing said protective cap from said upper portion of said cartridge;

modifying at least one of said protective cap or said upper portion of said cartridge whereby said protective cap can be secured to but still removeable from said upper portion of said cartridge; and injecting ink through a respective one of said holes into a particular one of said at least one chamber.

5. The method according to claim 4, wherein said step for modifying comprises the step of modifying said protective cap so that said cap can be reconnected to said cartridge after said cap has been removed from said upper portion of said cartridge, and said at least one chamber has been replenished with said ink.

6. The method according to claim 4 wherein said step of removing said protective cap comprises the step of prying off said protective cap from said upper portion of said cartridge utilizing a sharp utensil.

7. The method according to claim 4 wherein said protective cap and said upper portion of said cartridge are adhesively bonded together, said step of removing said protective cap from said upper portion of said cartridge comprises the step of dissolving said adhesive bond between said protective cap and said upper portion of said cartridge.

8. A user refillable ink jet cartridge assembly having an upper portion, a lower portion and protective cap, said upper portion having at least one chamber for containing ink, said upper portion containing holes providing access to each of said at least one chamber, said at least one chamber and said holes being covered by said protective cap, said cartridge assembly further including modifying means for modifying said cap or said upper portion, disposed on at least one of said protective cap or said upper portion of said cartridge whereby said protective cap can be secured to but still removeable from said upper portion of said cartridge so that when said ink is consumed during a period of time when said cartridge is in use, said at least one chamber may be replenished with said ink through said holes after said protective cap is removed by a removing means from said upper portion of said cartridge.

9. A user refillable ink jet cartridge assembly according to claim 8 wherein said protective cap is modified so that said cap can be reconnected to said cartridge after said chambers have been replenished with ink.

10. A user refillable ink jet cartridge assembly according to claim 8 wherein said means for removing said protective cap is a sharp utensil.

11. A user refillable ink jet cartridge assembly according to claim 8 wherein said protective cap is adhesively bonded to said upper portion of said cartridge, wherein said means for removing said protective cap include means for dissolving said bond between said cap and said upper portion of said cartridge.

* * * * *